US007536137B2

(12) United States Patent
Shin

(10) Patent No.: US 7,536,137 B2
(45) Date of Patent: May 19, 2009

(54) WET ELECTROPHOTOGRAPHIC IMAGE FORMING APPARATUS AND METHOD FOR CONTROLLING THE SAME

(75) Inventor: Joong-gwang Shin, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/272,824

(22) Filed: Nov. 15, 2005

(65) Prior Publication Data

US 2006/0110187 A1 May 25, 2006

(30) Foreign Application Priority Data

Nov. 24, 2004 (KR) ..... 10-2004-0097118

(51) Int. Cl.
*G03G 15/06* (2006.01)

(52) U.S. Cl. ..... 399/240; 399/55

(58) Field of Classification Search ..... 399/240, 399/241

See application file for complete search history.

(56) References Cited

U.S. PATENT DOCUMENTS 7,123,849 B2 * 10/2006 Ishii et al. ..... 399/54
2004/0131372 A1 * 7/2004 Fujita et al. ..... 399/57
2005/0180766 A1 * 8/2005 Shin et al. ..... 399/240

FOREIGN PATENT DOCUMENTS

| | | |
|---|---|---|
| JP | 08-278679 | 10/1996 |
| JP | 2002-202653 | 7/2002 |
| JP | 2003-015379 | 1/2003 |
| KR | 2000-0012988 | 3/2000 |

* cited by examiner

*Primary Examiner*—David M Gray
*Assistant Examiner*—Ruth N Labombard
(74) *Attorney, Agent, or Firm*—Roylance, Abrams, Berdo & Goodman, L.L.P.

(57) ABSTRACT

A wet electrophotographic image forming apparatus detects color per print page and executes printing by turning on only the development bias of a developing unit to be used for printing. The wet electrophotographic image forming apparatus has a color detecting unit for detecting colors for developing the electrostatic latent images per print page; and a controller for selectively turning on and turning off development bias applied to developing rollers of the plurality of the developing units according to the colors detected by the color detecting unit.

8 Claims, 7 Drawing Sheets

WET ELECTROPHOTOGRAPHIC IMAGE FORMING APPARATUS AND METHOD FOR CONTROLLING THE SAME

CROSS-REFERENCE TO RELATED APPLICATIONS

This application claims the benefit under 35 U.S.C. §119 (a) of Korean Patent Application No. 2004-97118, filed on Nov. 24, 2004, in the Korean Intellectual Property Office, the entire contents of which are hereby incorporated by reference.

BACKGROUND OF THE INVENTION

1. Field of the Invention

The present invention relates to a wet electrophotographic image forming apparatus and a method for controlling the same. More particularly, the present invention relates to a wet electrophotographic image forming apparatus and a method for controlling the same to individually control a development bias applied to a plurality of developing units.

2. Description of the Related Art

In general, a wet electrophotographic image forming apparatus is a printing apparatus for printing by using a liquid developing solution. The liquid development solution comprises a solidified particle toner for embodying colors and a liquefied carrier serving as solvent for solving the toner.

The wet electrophotographic image forming apparatus includes a light exposure unit for scanning laser beams according to printing data, a photosensitive medium on which electrostatic latent images are formed according to the laser beams emitted from the light exposure unit, a developing unit for developing the electrostatic latent images formed on the photosensitive medium, a transfer unit for transferring developed images to a printing medium, a fixation unit for fixing the images transferred onto the printing medium, a paper feeding unit staked with printing mediums and picking up each piece of paper from the stack of printing mediums, a printing medium conveying unit for conveying the printing medium, and a controller for controlling each said element to thereby conduct the printing process.

A wet electrophotographic image forming apparatus capable of printing in colors typically comprises four light exposure units and four developing units for developing four colors (ordinarily black, cyan, magenta and yellow).

Furthermore, the photosensitive medium includes four photosensitive drums corresponding to the four colors of developing units and a transferring belt for forming color images by allowing particular color images formed on the photosensitive drum to be transferred and overlapped, and for transferring the color images to the printing medium.

Now, a process of printing by the wet electrophotographic image forming apparatus will be explained in greater detail.

When the controller receives a printing command, the controller controls a light exposure unit so that laser beams corresponding to printing data received along with the printing command can be irradiated. The laser beams emitted from the light exposure unit form electrostatic latent images corresponding to the printing data on a surface of a photosensitive drum which is electrified to a predetermined voltage by a charging unit. When the photosensitive drum is rotated to allow a portion formed with the electrostatic latent images to be positioned opposite to the developing unit, the electrostatic latent images are developed in visible images by the developing solution of the developing unit. Now, a process of the electrostatic latent images on the photosensitive drum being developed by the developing unit will be explained in further detail.

Two bias voltages are used to move the developing solution from a developing solution deposit roller to a developing roller, and then to a photosensitive drum. First a developing solution supply bias is applied to a developing solution deposit roller for supplying the developing solution loaded in a developing solution container to a developing roller in order to help move the developing solution attached to the surface of the developing solution deposit roller to the surface of the developing roller. Next, the developing solution attached to the surface of the developing roller is moved to the surface of the photosensitive drum by a development bias to develop the electrostatic latent images to form the visible images.

When printing in full color, electrostatic latent images corresponding to each color are formed on the four photosensitive drums, and respective electrostatic latent images are developed in images of particular colors by the developing units corresponding to each photosensitive drum.

The visible images developed in particular colors on the plurality of photosensitive drums are transferred to and overlapped on the transferring belt to form images in full color. The images in full color formed on the transferring belt are transferred to the printing medium by the transfer unit. The images formed on the printing medium are fixed on the printing medium by the fixation unit. The printing medium having completed the fixation is discharged outside of a body of the image forming apparatus by the printing medium conveying unit.

Wet electrophotographic printing processes use a wet toner made up of a liquid carrier and solid toner particles. The carrier is used to move the toner to the electrostatic latent images of the photosensitive medium, and the toner particles form the color images. However, if there is a shortage of carrier liquid, the density of the developing solution increases to make the developing solution sludgy, resulting in problems such as insufficient circulation of the developing solution, among others. As a result, for the best performance it is necessary to maintain the density of the developing solution at a substantially constant level.

In order to maintain the density of the developing solution at a constant level, it is necessary to measure the density of the developing solution and to supply additional carrier as needed. There are two methods of replenishing the carrier for maintaining the density of the developing solution at a constant level. One method is to use new carrier and the other method is to reuse carrier by retrieving and condensing carrier liquid that was evaporated during the printing process.

However, there is a problem in the former method in that new carrier needs to be continuously supplied, causing an over-consumption of carrier. There is also a problem in the latter method in that a retrieval apparatus is needed for retrieving and condensing the evaporated carrier, adding cost and complexity to the printing apparatus.

Accordingly, there is a need for a wet electrophotographic printing apparatus which maintains a developing solution density at a constant level while minimizing the use of new carrier while avoiding the size and complexity of conventional carrier retrieval apparatuses.

SUMMARY OF THE INVENTION

Embodiments of the present invention are provided to solve the above mentioned problems and to provide other advantages. It is an object of the invention to provide a wet electrophotographic image forming apparatus adapted to minimize the consumption of carrier during the printing process by minimizing a quantity of carrier supplied for maintaining the density of developing solution at a constant level while also minimizing a size and complexity of a carrier retrieval apparatus used for retrieving evaporated carrier.

It is another object of the present invention to provide a control method of a wet electrophotographic image forming apparatus capable of minimizing the consumption of carrier during printing, which minimizes a quantity of carrier supplied for maintaining the density of developing solution at a substantially constant level while minimizing a size of a carrier retrieval apparatus used for retrieving evaporated carrier.

In accordance with one aspect of the present invention, there is provided a wet electrophotographic image forming apparatus, comprising a photosensitive medium on which electrostatic latent images are formed according to laser beams emitted from a light exposure unit; a plurality of developing units including a developing roller for transferring the developing solution to the photosensitive medium for developing the electrostatic latent images in particular colors; a transfer unit for transferring the images developed by the plurality of developing units to a printing medium; a fixation unit for fixing the images transferred on the printing medium; color detecting means for detecting colors for developing the electrostatic latent images per print page; and a controller for selectively turning on and turning off development bias applied to developing rollers of the plurality of the developing units according to the colors detected by the color detecting means. The plurality of developing units each comprise a developing solution container loaded with the developing solution; and a developing solution deposit roller for supplying the developing solution loaded in the developing solution container to the surface of the developing roller. The controller turns on and turns off developing solution supply bias applied to the developing solution deposit roller according to the colors detected by the color detecting means.

Preferably, the color detecting means counts and detects the number of dots of printing data.

Preferably, the controller selects more than one of pre-printing, printing and post-printing operations, and selectively turns on and off the development bias in the selected operation.

Preferably, the plurality of developing units further comprise developing solution density detecting means for detecting the density of the loaded developing solution.

Preferably, the controller selects more than one of pre-printing, printing and post-printing operations according to the density of the developing solution detected by the developing solution density detecting means, and selectively turns on and off the development bias during the selected operation.

In accordance with another object of the present invention, there is provided a method for controlling the wet electrophotographic image forming apparatus, the method comprising the steps of detecting the colors of a to-be-printed data per print page (color detecting step); turning on a development bias applied to a developing unit necessary for expressing the colors detected in the color detecting step, and turning off a development bias applied to a developing unit not necessary for expressing the colors detected in the color detecting step (development bias control step); and forming images by the plurality of developing units and printing the images on a printing medium (printing step).

Preferably, the development bias control step further comprises the steps of detecting the density of the developing solution filled in the plurality of developing units (density detecting step); and selecting more than one of the pre-printing, printing and post-printing operations according to the density of the developing solution detected at the density detecting step (operation selecting step).

Preferably, the development bias control step turns on and turns off the developing solution supply bias in the same way as in the development bias.

There are advantages in the wet electrophotographic image forming apparatus thus described according to embodiments of the present invention in that, because carrier consumption can be minimized during printing, a minimized amount of carrier is used for maintaining a concentration of developing solution at a constant level. Therefore, minimum capacity is required for a carrier retrieval apparatus to retrieve the evaporated carrier. If the carrier is minimally consumed during the printing process as explained in the foregoing, a sludge problem arising from an increased density of the developing solution when printed in a low print coverage, an insufficient circulation of developing solution during supply and retrieval of the developing solution, and occurrence image errors such as snow flakes and the like can be improved. Furthermore, a the useful life of the developing units can be improved.

Still further, there are advantages in the control method of the wet electrophotographic image forming apparatus thus described according to embodiments of the present invention in that, because carrier consumption can be minimized during printing, a minimized amount of carrier is used for maintaining a concentration of developing solution at a substantially constant level. Therefore, minimum capacity is required for a carrier retrieval apparatus to retrieve the evaporated carrier. As a result, the image problems and shortened life of the developing unit can be reduced.

BRIEF DESCRIPTION OF THE DRAWINGS

For fuller understanding of the nature and objects as well as advantages of embodiments of the present invention, reference should be made to the following detailed description taken in conjunction with the accompanying drawings in which:

FIG. 3A illustrates a print execution mode of 2:3, FIG. 3B illustrates a print execution mode of 2:8, and FIG. 3C illustrates a print execution mode being a continued mode;

Throughout the drawings, like reference numbers will be understood to refer to like features, elements; and structures.

DETAILED DESCRIPTION OF EXEMPLARY EMBODIMENTS

Hereinafter, exemplary embodiments of the present invention will be described in detail with reference to FIGS. 1-3, where phenomena of a carrier being consumed during the printing are studied through experiments in order to accomplish the objects of the present invention to minimize the consumption of the carrier during the printing.

Figure 1:
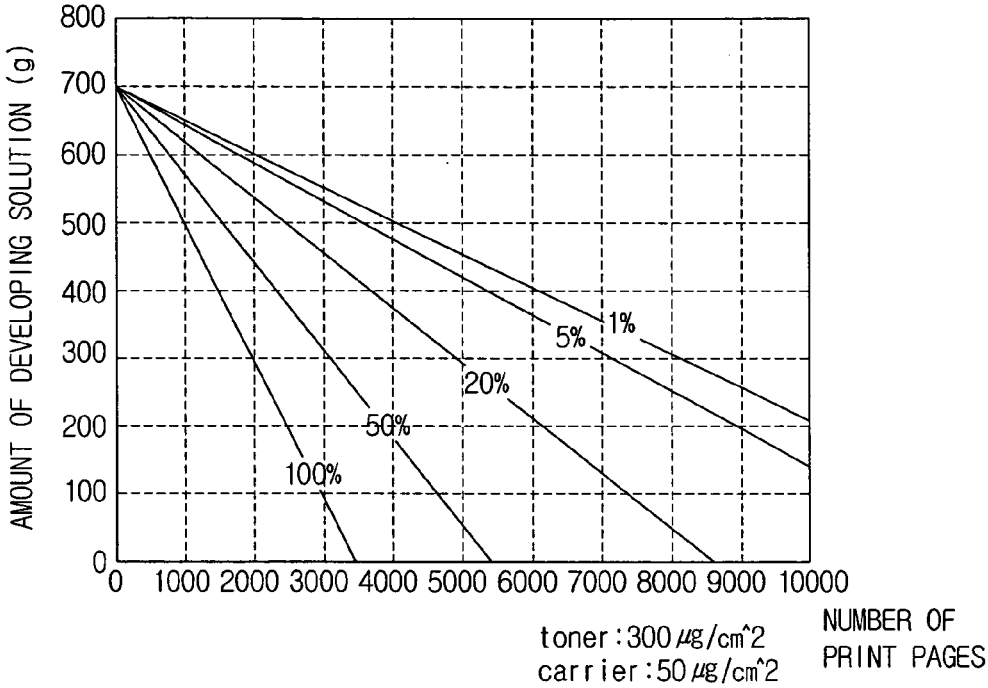
FIG. 1 (PRIOR ART)
FIG. 1 is a graph illustrating a relationship between the number of printed pages and consumption of the developing solution in relation to a print coverage per printed page.

FIG. 1 illustrates a relationship between the number of printed pages and consumption of the developing solution in relation to a print coverage per printed page. An experiment was made with developing solution of 700 grams with a density of 12% solid, and it was presumed that weights of toner and carrier consumed per unit area are respectively 300 μg/cm$^2$ and 50 μg/cm$^2$.

As shown in FIG. 1, the developing solution was decreased as the number of printed pages was increased. In the case where a print coverage per printed page (hereinafter referred to as 'print coverage') was 1%, approximately 200 grams of developing solution remained when 10,000 pages were printed. Meanwhile, in the case where a print coverage per printed page was 5%, approximately 100 grams of developing solution remained when 10,000 pages were printed. As the print coverage was increased, the number of printable pages was decreased, such that, in case of a print coverage being 100%, no developing solution remained when approximately 3,500 pages were printed. In other words, the remnant developing solution was proportionately decreased as the print coverage and the number of the printed pages was increased.

Figure 2:
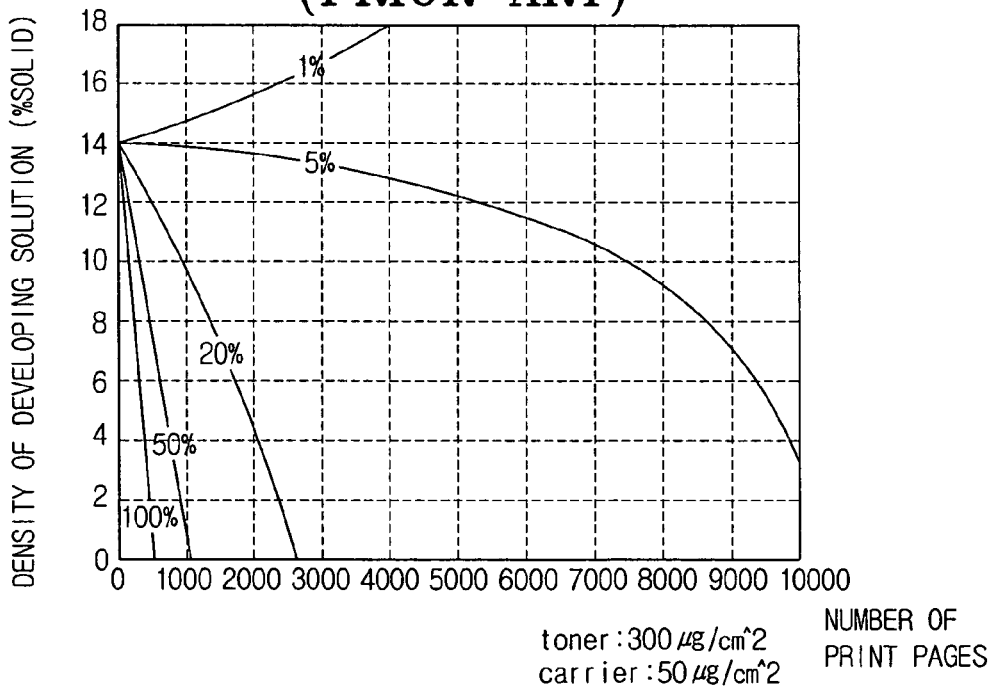
FIG. 2 (PRIOR ART)
FIG. 2 is a graph illustrating a relationship between the number of printed pages and density (% solid) of the developing solution in relation to a print coverage per printed page.

FIG. 2 is a graph illustrating a relationship between the number of printed pages and density (% solid) of the developing solution in relation to a print coverage per printed page, where it was assumed that the solid density of the developing solution prior to start of the printing was 14% and weights of toner and carrier consumed per unit area were respectively 300 μg/cm$^2$ and 50 μg/cm$^2$.

Referring to FIG. 2, in the case that a print coverage was 1%, when the number of printed pages was increased, the solid density of the remnant developing solution was increased, such that density of 14% prior to the printing was increased to 18% following the printing of 4,000 pages. Furthermore, in the case that the print coverage was 5%, the solid density of the remnant developing solution was exponentially decreased to just over 3% when 10,000 pages were printed. In the case that the print coverage was 20% or more, the density of the remnant developing solution was reduced to about zero making it impossible to print after approximately 2,700 pages were printed. As the print coverage is increased, the number of printable pages is drastically decreased, such that, in the case that the print coverage is 100%, and when approximately 500 pages are printed, the density of the remnant developing solution comes to about zero making it impossible to print. In other words, when the print coverage percentage is large, a large quantity of toner is used while a small quantity of carrier is used, such that the quantity of toner is drastically reduced in the remnant developing solution, while carrier remains relatively unchanged, causing the developing solution density to be drastically decreased. As a result, consumption of carrier causes no problem in this case.

Figure 3A:
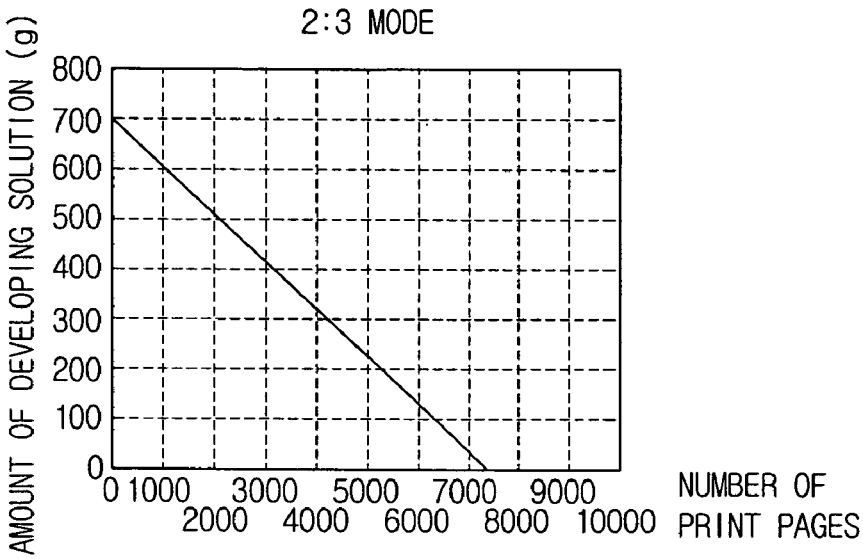
FIG. 3A (PRIOR ART)
FIGS. 3A to 3C are graphs illustrating a relationship between the number of printed pages and consumption of the developing solution in relation to a print execution mode, where
Figure 3B:
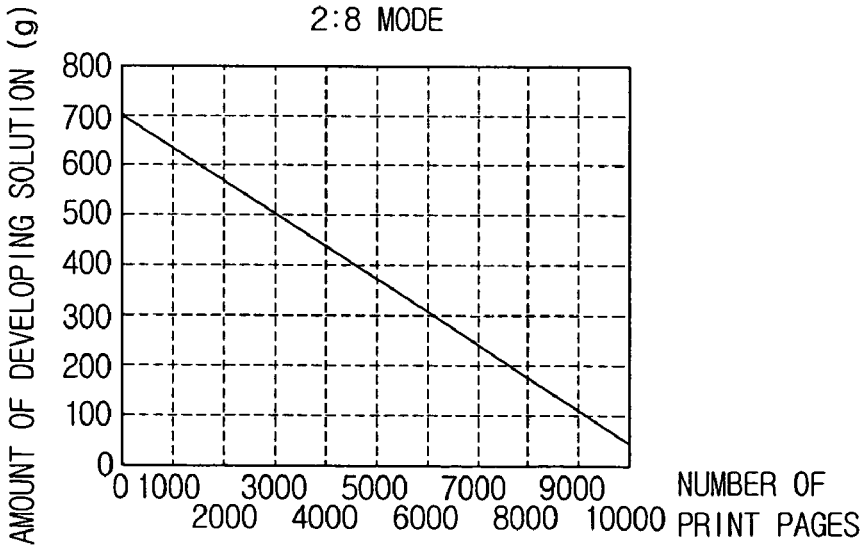
FIG. 3B (PRIOR ART)
Figure 3C:
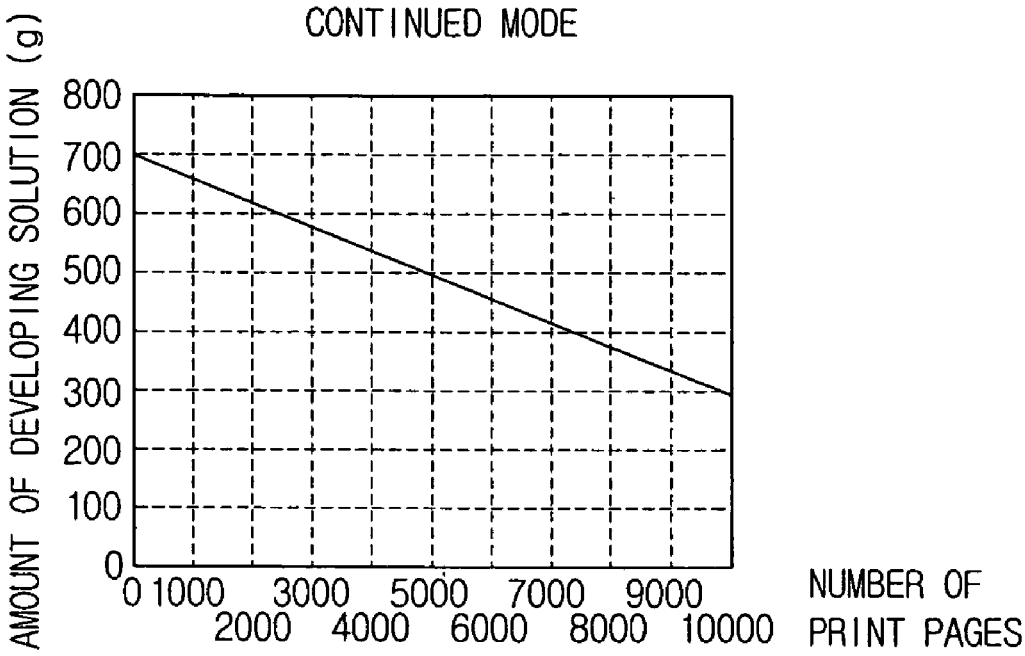
FIG. 3C (PRIOR ART)

FIGS. 3A-3C are graphs illustrating a relationship between the number of printed pages and consumption of the developing solution in relation to a print execution mode, where the print execution mode defines a mode in a continuous print, according to which a certain number of pages are printed, the print idles and then proceeds to the next print. For example, an establishment is made in such a way that, under 2:3 mode, if 5 pages are supposed to be continuously printed, two pages are printed first, then the printing process idles for a predetermined time, and then the remaining three pages are printed. Under 2:8 mode, if ten pages are supposed to be continuously printed, first two pages are printed, then the printing process idles for a predetermined time, and then the remaining eight pages are printed. For continued mode, pages are printed continuously without any idling until all the pages are printed. Furthermore, an experiment was performed with developing solution of 700 grams having a 12% solid density, and it was assumed that weights of toner and carrier consumed per unit area were respectively given as 300 μg/cm$^2$ and 50 μg/cm$^2$.

FIG. 3A illustrates a print execution mode of 2:3 mode, where, when 6,000 pages are printed, the developing solution is reduced to just above 100 grams making it impossible to print. At this time, the solid density of the developing solution was 12% prior to start of the print, but was increased to 18% after the print of 4,500 sheets of paper.

FIG. 3B illustrates a print execution mode of 2:8 mode, where the developing solution was reduced to about 100 grams following the print of 9,000 sheets of paper, thereby making it impossible to print. At this time, the solid density of the developing solution was 12% prior to start of the print but increased to 13.6% after the completion of 9,000 sheets of paper.

FIG. 3C illustrates a print execution mode of continued mode, where 300 grams of developing solution remains after 10,000 sheets of paper were printed. In this printing mode, the solid density of the developing solution was 12% prior to the start of the print and fell to 2% following the print of 10,000 sheets of paper.

In order to find out why the density of the developing solution is so abruptly changed according to the print coverage and the print execution mode, an experiment was performed where the development bias applied to the developing roller of the developing unit for developing black, cyan, magenta and yellow was turned on and off, and the quantity of consumed carrier was measured. A result of the experiment is given in Table 1.

TABLE 1

| Carrier consumption during turned-off development bias | | | | Carrier consumption during turned-on development bias | | | |
|---|---|---|---|---|---|---|---|
| K | C | M | Y | K | C | M | Y |
| 10 ± 1 | 11 ± 1 | 10 ± 1 | 8 ± 1 | 30 ± 1 | 24 ± 1 | 30 ± 1 | 28 ± 1 |

The unit of carrier consumption is μg/cm$^2$, K is a developing unit of black, C is a developing unit of cyan, M is a developing unit of magenta, and Y is a developing unit of yellow.

As shown in Table 1, when the development bias is turned on, the carrier consumption is larger by between 13 μg/cm$^2$ and 20 μg/cm$^2$ per developing unit of each color than when the development bias is turned off. For that reason, in order to minimize the carrier consumption during the printing process, it can be noted that it is necessary to turn off a development bias of a developing unit that is not needed for the development in the developing process. In other words, when a single color is to be printed, a development bias applied to a developing unit for development of unused colors should be turned off, and only the development bias of the developing unit used for the development should be turned on. Furthermore, even when printing in two colors, the development bias of only the two developing units for development of the particular colors used should be turned on while the development biases of the other developing units should be turned off. Similarly, if three colors are used, the development bias of the developing unit for the unused color should be turned off.

Now, an embodiment of the wet electrophotographic image forming apparatus according to an embodiment of the present invention will be described in detail with reference to the accompanying drawings.

Figure 4:
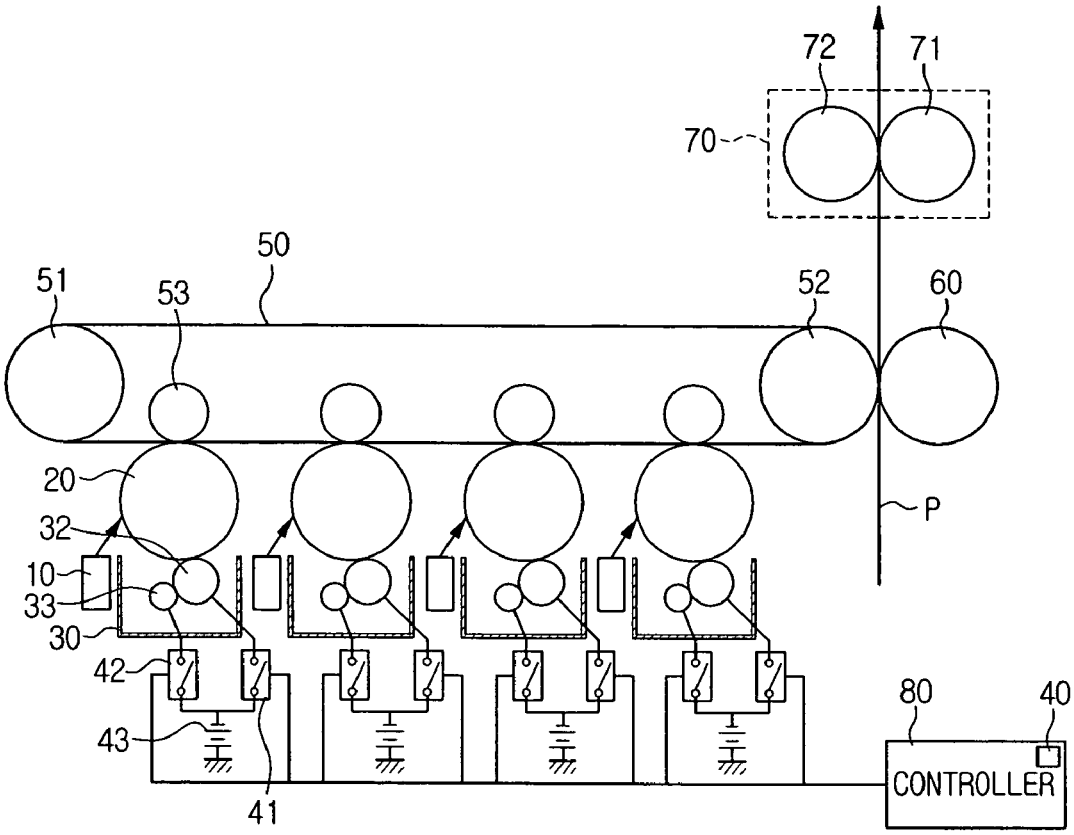
FIG. 4 is a schematic drawing for illustrating an embodiment of a wet electrophotographic image forming apparatus according to an embodiments of the present invention.
Figure 5:
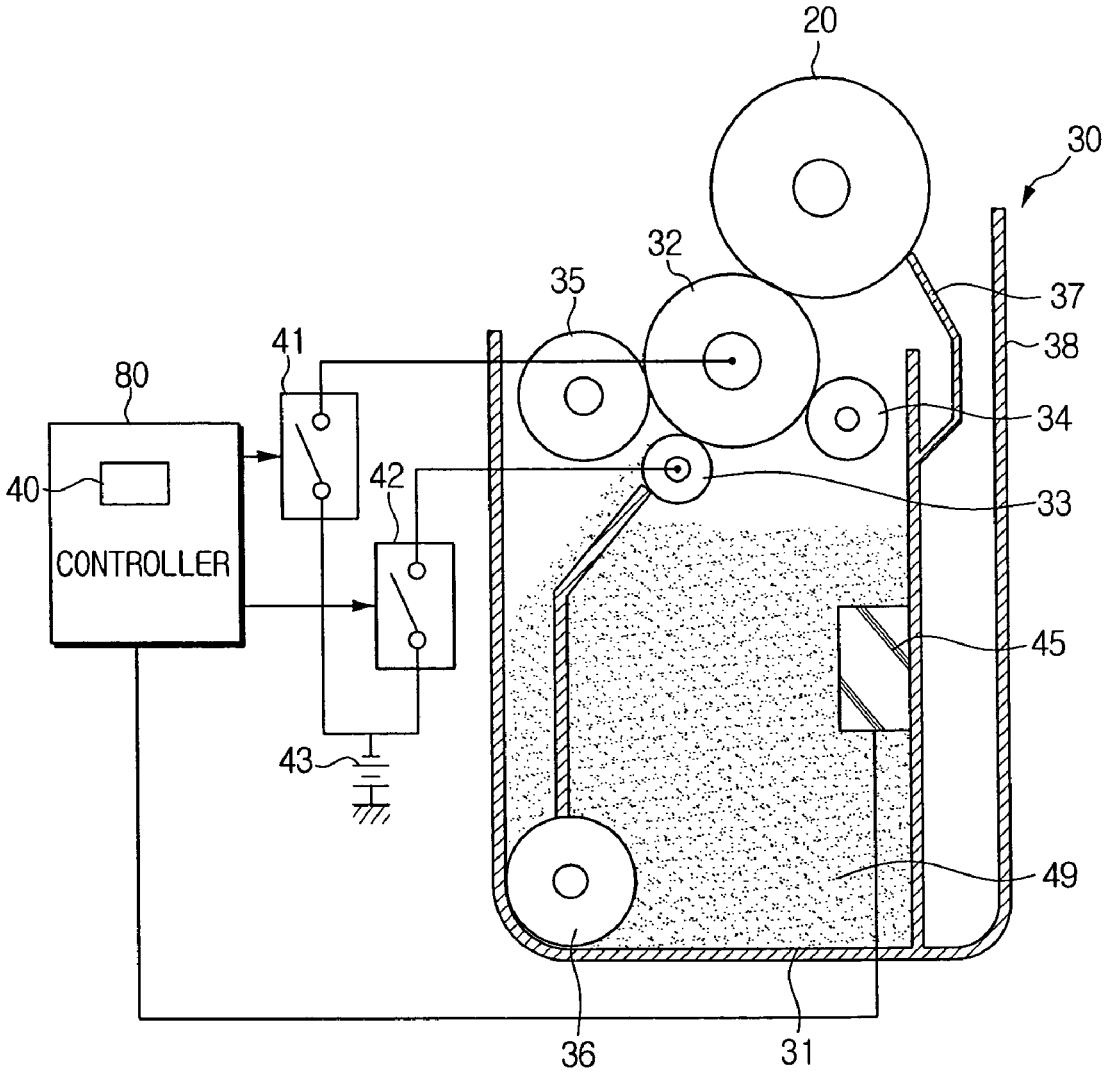
FIG. 5 is a schematic drawing for illustrating a structure of a developing unit of the wet electrophotographic image forming apparatus in FIG. 4.

Referring to FIGS. 4 and 5, the wet electrophotographic image forming apparatus according to an embodiment of the invention includes a plurality of light exposure units (10), a plurality of photosensitive drums (20), a plurality of developing units (30), a transfer belt (50), a transfer unit (60), a fixation unit (70) and a controller (80). The wet electrophotographic image forming apparatus further includes a paper feeding unit (not shown) and a printing medium conveying unit (not shown) for feeding and conveying a printing medium.

The light exposure unit 10 can be a laser scanning unit for scanning laser beams according to print data. The photosensitive drum (20) is rotated at a predetermined speed, and is charged on the surface thereof with a predetermined voltage by a charging unit (not shown).

The developing unit (30) includes a developing solution container (31) filled with developing solution (49), a developing roller (32) for feeding the developing solution (49) to the photosensitive drum (20) and a developing solution deposit roller (33) for supplying the developing solution (49) from the developing solution container (31) to the surface of the developing roller (32). Furthermore, the developing roller (32) is further provided at one side thereof with a metering roller (34) for regulating to a predetermined level the thickness of the developing solution deposited on the surface of the developing roller (32), and a cleaning roller (35) for removing the developing solution (49) remaining on the surface of the developing roller (32) after transferring developing solution to the photosensitive drum (20). An agitating roller (36) is mounted on the floor of the developing solution container (31) for agitating the developing solution (49).

The developing roller (32) is connected to an electric power source (43) for applying the development bias, and the developing solution deposit roller (33) is connected to the electric power source (43) for applying the developing solution supply bias. Referring to FIG. 5, the same electric power source (43) is shown for applying the development bias and for applying developing solution supply bias. However it should be understood that separate power supplies may be used for each. Between the developing roller (32) and the electric power source (43) there is disposed a first switch (41) for turning on and off the development bias applied to the developing roller (32). Between the developing solution deposit roller (33) and the electric power source (43) there is disposed a second switch (42) for turning on and off the developing solution supply bias. The first and second switches (41,42) are electrically connected to the controller (80) to be turned on and off by a signal from the controller (80) such that the development bias and the developing solution supply bias applied from the electric power source (43) to the developing roller (32) and the developing solution deposit roller (33) can be turned on and off.

Furthermore, the developing solution container (31) has a density detecting means (45) disposed at an inner predetermined side thereof for detecting the density of the developing solution (49). The density detecting means (45) is a density sensor which is electrically connected to the controller (80), such that the controller (80) can check the density of the developing solution (49) filled in the developing solution container (31). Cleaning blade (37) removes waste developing solution from the photosensitive drum (20), and waste developing solution container (38) receives waste developing solution removed from the photosensitive drum (20).

Four devices each consisting of the light exposure units (10), photosensitive drums (20) and developing units (30) are sequentially mounted along the transfer belt (50) for developing colors such as black, cyan, magenta and yellow. The transfer belt (50) moves in an endless track motion on two pulleys (51, 52), and images of particular colors developed on the plurality of photosensitive drums (20) are transferred and overlapped to form mono-color or full-color images. A plurality of transfer rollers (53) are disposed along the transfer belt (50) to face the respective photosensitive drums (20). The transfer belt (50) forms an exemplary transfer mechanism along with the plurality of photosensitive drums (20). Although the transfer mechanism according to the exemplary embodiment of the present invention described herein comprises a plurality of photosensitive drums (20) and transfer belt (50), a transfer mechanism may also comprise a single photosensitive drum and a plurality of developing units sequentially formed about the photosensitive drum to form colored images, as will be appreciated by those of ordinary skill in the art.

The transfer unit (60) serving to transfer colored images formed on the transfer belt (50) to a printing medium (P) is installed to contact the surface of the transfer belt (50) and to rotate thereon. The fixation unit (70) applies heat and pressure to the printing medium (P) to fix the transferred color images to the printing medium (P). The fixation unit (70) includes a pressure roller (72) and a heating roller (71).

A color detecting means (40) functions to check whether the color of print data is of mono-color, multi-color of two or three colors, or full color for each page to be printed. Color detecting means may come in any suitable form, but the color detecting means (40) according to an exemplary embodiment of the present invention is constructed to count dots of the printing medium in detecting color of the print data. The color detecting means (40) thus explained may be constructed as a part of the controller (80). The method of detecting the colors of the printing data by counting the number of dots therein is known in the art and thus a detailed description thereof is omitted for clarity and conciseness.

The controller (80) serves to control the plurality of light exposure units (10), the plurality of photosensitive drums (20), the plurality of developing units (30), the transfer belt (50), the transfer unit (60), the fixation unit (70), the paper feeding unit and the printing medium conveying unit to conduct the printing process. According to an embodiment of the invention, the controller (80) turns on and off the first and second switches (41, 42) according to the colors detected by the color detecting means (40), whereby the development bias and the developing solution supply bias applied to the developing roller (32) and the developing solution deposit roller (33) are turned on and off.

The controller (80) may be so established as to turn on or off the development bias and the developing solution supply bias during one, or all of the pre-printing, printing and post-printing operations, which will be described in greater detail below.

A conventional image forming apparatus is set up to idle for a predetermined period of time before the start of printing and after the completion of the printing.

The operation of the image forming apparatus may be divided into three operations. The first is a pre-printing operation where the image forming apparatus idles prior to an actual execution of printing. The second is a printing operation where an actual printing is performed. The third is a post-printing operation where the image forming apparatus idles after the completion of printing.

Accordingly, the controller (80) may be established in such a way that the development bias is turned on or off in only one of the pre-printing, printing and post-printing operations according to the color detected by the color detecting means (40). Alternatively, the controller (80) may be established in such a way that the development bias is turned on or off in two of the pre-printing, printing and post-printing according to the color detected. Or, the controller (80) may be established in such a way that the development bias is turned on or off in all of the pre-printing, printing and post-printing operations according to the colors detected. Or, the controller (80) may be established in such a way that, which of the pre-printing, printing and post-printing operations that the development bias is turned on or off according to the colors detected by the color detecting means (40), is determined according to the density of the developing solution (49) detected by the density detecting means (45). In the exemplary embodiment, the developing solution supply bias is controllably set up in the same way as the development bias.

Now, operation of the wet electrophotographic image forming apparatus thus constructed according to an embodiment of the present invention will be described in detail with reference to FIGS. 4 and 5.

When printing data is received along with a printing command, the controller (80) transmits the printing data to the plurality of light exposure units (10). The plurality of light exposure units (10) emit the laser beams corresponding to respective printing data to a plurality of corresponding photosensitive drums (20). Electrostatic latent images corresponding to the printing data are formed on a surface of the plurality of photosensitive drums (20) charged to a predetermined voltage by a charging unit (not shown) by the laser beams.

The electrostatic latent images formed on the photosensitive drums (20) are developed in visible images of particular colors by the developing solution (49) supplied by the developing units (30) in response to the rotation of the photosensitive drums (20). At this time, the color detecting means (40) counts the number of dots of printing data to identify the colors of the printing pages, and transmits a signal to the controller (80) corresponding to the colors to be printed.

Successively, the controller (80) turns on and off the first and second switches (41, 42) according to the colors to be printed, whereby the development bias and the developing solution supply bias are turned on and off. For example, if the color to be printed calls for a single tone color, that is, one color out of black, cyan, magenta and yellow, only the developing solution supply bias and the development bias of developing unit (30) of corresponding color are turned on, while the developing solution supply bias and the development biases of developing units (30) of different colors are turned off.

For example, if the printing calls only for black, only the developing solution supply bias and the development bias of the black developing unit (30) are turned on while the developing solution supply bias and the development biases of the cyan, magenta and yellow developing units (30) are turned off.

If two colors are to be printed, the developing solution supply biases and the development biases of two developing units (30) necessary for developing the corresponding colors are turned on, while the developing solution supply biases and the development biases the other colors of developing units (30) are turned off. If developing solution supply biases and development biases of the developing units (30) not used for the development are turned off, the consumption of carrier is reduced as shown in Table 1 as compared to a case where the development bias and the developing solution supply bias are turned on.

Figure 6:
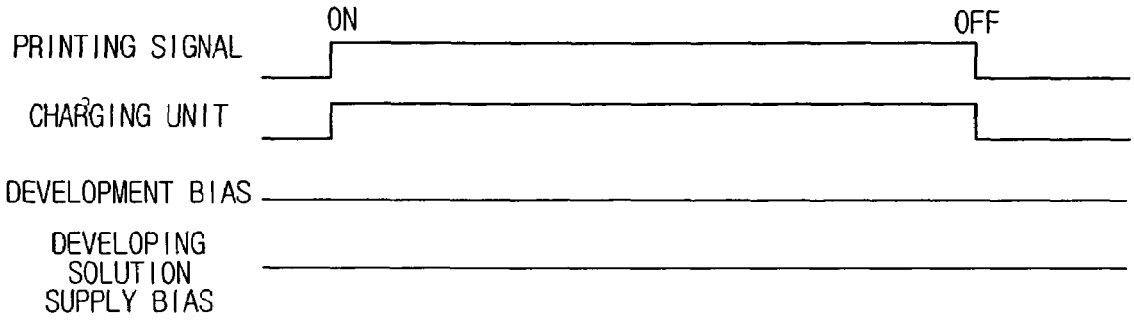
FIG. 6 is a timing chart for illustrating a case where a development bias and a developing solution supply bias of the developing unit are turned off in a wet electrophotographic image forming apparatus according to an embodiment of the present invention.
Figure 7:
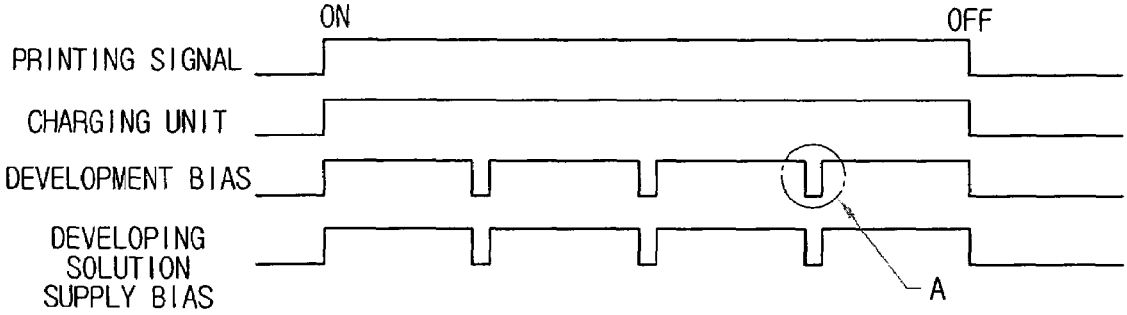
FIG. 7 is a timing chart for illustrating a case where a development bias and a developing solution supply bias of the developing unit are turned on in a wet electrophotographic image forming apparatus according to an embodiment of the present invention.

FIG. 6 is a timing chart of the developing unit (30) when a developing solution supply bias and a development bias of the developing unit are turned off, and FIG. 7 is a timing chart of the developing unit (30) when a development bias and a developing solution supply bias of the developing unit are turned on, wherein "A" represents a gap between electrostatic latent images to be developed by the developing unit (30).

As explained in the foregoing, the controller (80) may controllably turn on and off the development bias and the developing solution supply bias of the developing unit (30) during more than one of the three operations, that is, pre-printing, printing and post-printing.

The images on the plurality of photosensitive drums (20) developed in colors according to the developing solution (49) supplied by the developing roller (32) are transferred and overlapped to the transfer belt (50) to form color images. The images formed by being transferred to and overlapped onto the transfer belt (50) are transferred by the transfer unit (60) to the printing medium (P) passing between the transfer belt (50) and the transfer unit (60). The printing medium (P) is picked up one sheet at a time by the paper feeding unit (not shown) and conveyed to the transfer unit (60) by the printing medium conveying unit. The printing medium (P) whose having images thereon is conveyed to the fixation unit (70) by the printing medium conveying unit, and the transferred images are fixed on the printing medium (P) by the heat and pressure of the fixation unit (70). The fixed printing medium (P) is discharged outside of the image forming apparatus.

Now, in accordance with another aspect of the present invention, a control method of the wet electrophotographic image forming apparatus thus described will be described with reference to the accompanying FIGS. 4, 5, 8 and 9, where "S" denotes a method step.

Figure 8:
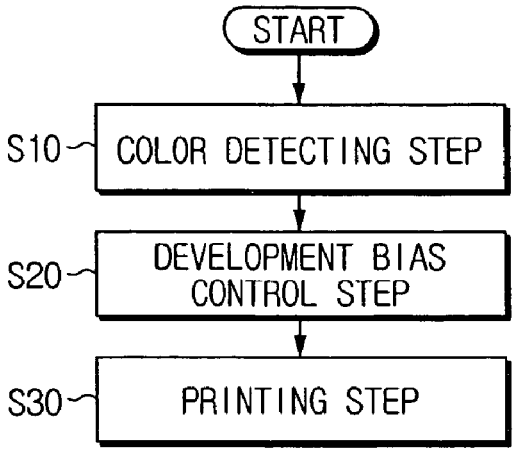
FIG. 8 is a flow chart for illustrating a control method of a wet electrophotographic image forming apparatus according to an embodiment of the present invention.
Figure 9:
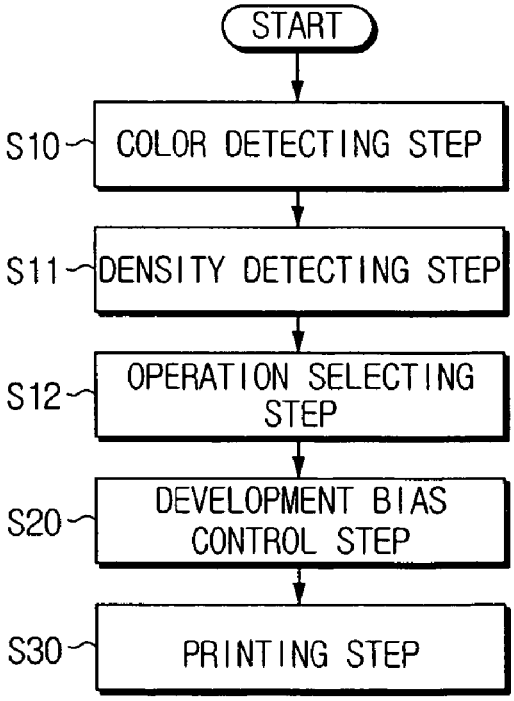
FIG. 9 is a flow chart for illustrating another control method of a wet electrophotographic image forming apparatus according to an embodiment of the present invention.

FIG. 8 is a flow chart illustrating a control method of a case where the density of the developing solution filled in the developing solution container is not detected while FIG. 9 is a flow chart for illustrating a control method of a case where the density of the developing solution filled in the developing solution container is detected.

When a printing command is received, the color detecting means (40) uses the number of dots of received printing data to identify the colors of data to be printed, and transmits a signal of the color to be printed to the controller (80) (step S10). Successively, the controller (80) turns on the development bias applied to the developing roller (32) at the developing unit (30) to be used for the printing in response to the received color signal of the color detecting means (40), and the development bias of the developing unit (30) not to be used for the printing is turned off (step S20). Preferably, the developing solution supply bias applied to the developing solution deposit roller (33) of the developing unit 30 is also turned on and off in the same way as the development bias.

Following the turning-on and turning-off of the development biases of the plurality of developing units (30) according to the colors to be printed, the controller (80) prints the images of the printing data on the printing medium (P) supplied by conducting the printing process in the same way as that of the conventional wet electrophotographic image forming apparatus (step S30).

If the controller (80) is so established as to select an operation for controlling the development bias according to the density of the developing solution (49) identified by the density detecting means (45) mounted at the developing unit (30), a density detecting step (step S11) and an operation selecting step (step S12) are further included between the color detecting step (S10) and the development bias control step (S20), as illustrated in FIG. 9.

In other words, the controller (80) determines the density of the developing solution of colors to be developed via the density detecting means (45) mounted at the developing unit (30) (step S11) after the colors to be printed by the color detecting means (40) are detected (step S10). Successively, more than one of the pre-printing, printing and post-printing operations is selected in accordance with the established condition (step S12). Following the turning-on and turning-off of the development bias (step S20), printing is conducted on the printing medium (P) (step S30).

While exemplary embodiments of the present invention have been disclosed herein are the preferred forms, other embodiments of the present invention will suggest themselves to persons skilled in the art in view of this disclosure. Therefore, it will be understood that variations, additions, deletions and modifications the embodiments described herein can be made without departing from the spirit and scope of the invention. Accordingly, the scope of the present invention should only be limited by the following listing of claims.

What is claimed is:

1. A wet electrophotographic image forming apparatus comprising:

a photosensitive medium on which electrostatic latent images are formed in accordance a light exposure unit based on print data;

a plurality of developing units including a developing roller to transfer the developing solution to the photosensitive medium to develop the electrostatic latent images in particular colors, and a developing solution density detecting means to detect the density of the developing solution;

a transfer unit to transfer the images developed by the plurality of developing units to a printing medium;

a fixation unit to fix the images onto the printing medium;

a color detecting unit to detect colors for developing the electrostatic latent images of a printed page; and a controller to selectively turn on and off development bias applied to developing rollers of the plurality of the developing units according to the colors detected by the color detecting unit;

wherein the controller selects a separate on or off state for each of pre-printing, printing and post-printing operations based on the detected density of the developing solution detected by the developing solution density detecting means, and selectively turns on or off the development bias during the selected operations according to the selected separate on or off state for each operation.

2. The apparatus of claim 1, wherein each of the plurality of developing units comprises: a developing solution container loaded with the developing solution; and a developing solution deposit roller to supply the developing solution loaded in the developing solution container to the surface of the developing roller, and wherein the controller turns on and turns off a developing solution supply bias applied to the developing solution deposit roller according to the colors detected by the color detecting unit.

3. The apparatus of claim 1, wherein the color detecting unit detects colors of the print data by counting the number of dots of the print data.

4. The apparatus of claim 1, wherein the controller selects the separate on or off state for each of the pre-printing, printing and post-printing operations individually for each color according to the density of the developing solution detected for that color.

5. A method for controlling a wet electrophotographic image forming apparatus, the method comprising the steps of:

detecting the colors of print data to be printed on a page;

detecting the density of the developing solution filled in the plurality of developing units;

selecting a separate on or off state for each of pre-printing, printing and post-printing operations according to the density of the developing solutions detected;

turning on a development bias applied to a developing unit necessary for expressing the colors detected in the color detecting step during operations for which the on state was separately selected and turning off the development bias applied to said developing unit during operations for which the off state was separately selected, and turning off a development bias applied to a developing unit not necessary for expressing the colors detected in the color detecting step; and forming images using the plurality of developing units and printing the images on a printing medium.

6. The method of claim 5, wherein the development bias control step further comprises the step of turning on and off a developing solution supply bias in substantially the same way as the development bias.

7. A computer readable medium of instructions for controlling an electrophotographic image forming apparatus comprising:

a first set of instructions adapted to control the image forming apparatus to detect the colors of print data to be printed on a page;

a second set of instructions adapted to control the image forming apparatus to detect the density of the developing solution filled in the plurality of developing units;

a third set of instructions adapted to control the image forming apparatus to select a separate on or off state for each of pre-printing, printing and post-printing operations according to the density of the developing solutions detected;

a fourth set of instructions adapted to control the image forming apparatus to turn on a development bias applied to a developing unit necessary for expressing the detected colors during operations for which the on state was separately selected and to turn off the development bias applied to said developing unit during operations for which the off state was separately selected;

a fifth set of instructions adapted to control the image forming apparatus to form images using the plurality of developing units and print the images on a printing medium.

8. The computer readable medium of instructions of claim 7, further comprising:

a sixth set of instructions adapted to control the image forming apparatus to turn on and off a developing solution supply bias in substantially the same way as the development bias.

* * * * *